US009192036B2

(12) United States Patent
Wang et al.

(10) Patent No.: US 9,192,036 B2
(45) Date of Patent: Nov. 17, 2015

(54) POWER APPARATUS FOR X-RAY TUBE, POWER SYSTEM WITH THE POWER APPARATUS, AND METHOD OF OPERATING THE SAME

(71) Applicant: Delta Electronics, Inc., Taoyuan County (TW)

(72) Inventors: Ming-Whang Wang, Taoyuan County (TW); Hong-Wen Chen, Taoyuan County (TW)

(73) Assignee: DELTA ELECTRONICS, INC. (TW)

( * ) Notice: Subject to any disclaimer, the term of this patent is extended or adjusted under 35 U.S.C. 154(b) by 396 days.

(21) Appl. No.: 13/845,834

(22) Filed: Mar. 18, 2013

(65) Prior Publication Data

US 2014/0185774 A1 Jul. 3, 2014

(30) Foreign Application Priority Data

Dec. 28, 2012 (TW) ..... 101150843 A

(51) Int. Cl.
*H05G 1/32* (2006.01)
*H05G 1/10* (2006.01)

(52) U.S. Cl.
CPC ... *H05G 1/32* (2013.01); *H05G 1/10* (2013.01)

(58) Field of Classification Search
CPC ..... H05G 1/10; H05G 1/12; H05G 1/14; H05G 1/18; H05G 1/32; H05G 1/56
See application file for complete search history.

(56) References Cited

U.S. PATENT DOCUMENTS 6,496,563 B1 * 12/2002 Bacon ..... H05G 1/10 378/101
2009/0290683 A1 * 11/2009 Loef ..... H05G 1/10 378/104
2014/0064455 A1 * 3/2014 Park ..... H05G 1/12 378/104

* cited by examiner

*Primary Examiner* — Glen Kao
(74) *Attorney, Agent, or Firm* — Hauptman Ham, LLP

(57) ABSTRACT

A power system with a power apparatus for an X-ray tube is disclosed. The power system includes an X-ray tube and a power apparatus for the X-ray tube. The X-ray tube has a cathode and an anode. The power apparatus includes a first power conversion unit, a second power conversion unit, and a power switch unit. The first power conversion unit produces a positive voltage and a driving voltage and the second conversion unit produces a negative. When the power switch unit is turned off by the driving voltage, the power apparatus outputs the negative voltage to suppress electron flow energy generated from the cathode of the X-ray tube, whereas the power apparatus outputs the positive voltage to provide electron flow energy to the anode of the X-ray tube when the power switch unit is turned on by the driving voltage, thus producing X-ray.

20 Claims, 5 Drawing Sheets

POWER APPARATUS FOR X-RAY TUBE, POWER SYSTEM WITH THE POWER APPARATUS, AND METHOD OF OPERATING THE SAME

BACKGROUND

1. Technical Field

The present disclosure relates generally to a power apparatus for an X-ray tube, a power system with the power apparatus, and a method of operating the same, and more particularly to a power apparatus for a grid-controlled X-ray tube, a power system with the power apparatus, and a method of operating the same.

2. Description of Related Art

The power circuits of the X-ray tube is mainly composed of a main power circuit and a filament power circuit. The main power circuit is used to step up the external AC power voltage to produce a high voltage by a high-voltage transformer. The produced high voltage is applied between a cathode and an anode of the tube so that electrons generated from the cathode are struck on the anode to produce X-ray. The filament power circuit is used to step down the external AC power voltage to produce a low voltage by a filament transformer. The produced low voltage is applied between two terminals of the filament so that the filament can provide sufficient electrons by thermionic radiation.

Accordingly, it is desirable to provide a power apparatus for an X-ray tube, a power system with the power apparatus, and a method of operating the same that only one power switch unit is used to implement the polarity control of the grid voltage so as to reduce system costs and increase system operation stability.

SUMMARY

An object of the present disclosure is to provide a power apparatus for an X-ray tube to solve the above-mentioned problems. Accordingly, the power apparatus for the X-ray tube includes a first power conversion unit, a second power conversion unit, and a power switch unit. The first power conversion unit has a first transformer, the first transformer is configured to receive a first AC voltage and convert the first AC voltage to produce a positive voltage and a driving voltage. The second power conversion unit has a second transformer, the second transformer is configured to receive a second AC voltage and convert the second AC voltage to produce a negative voltage. The power switch unit is connected to the first transformer and the second transformer. The power apparatus is configured to output the positive voltage when the power switch unit is turned on by the driving voltage; the power apparatus is configured to output the negative voltage when the power switch unit is turned off by the driving voltage.

Another object of the present disclosure is to provide a power system with a power apparatus for an X-ray tube to solve the above-mentioned problems. Accordingly, the power system with the power apparatus for the X-ray tube includes an X-ray tube and a power apparatus. The X-ray tube has a cathode and an anode. The power apparatus is electrically connected to the X-ray tube. The power apparatus includes a first power conversion unit, a second power conversion unit, and a power switch. The first power conversion unit has a first transformer, the first transformer is configured to receive a first AC voltage and convert the first AC voltage to produce a positive voltage and a driving voltage. The second power conversion unit has a second transformer, the second transformer is configured to receive a second AC voltage and convert the second AC voltage to produce a negative voltage. The power switch unit is connected to the first transformer and the second transformer. The power apparatus is configured to output the positive voltage when the power switch unit is turned on by the driving voltage; the power apparatus is configured to output the negative voltage when the power switch unit is turned off by the driving voltage.

Further another object of the present disclosure is to provide a method of operating a power system with a power apparatus for an X-ray tube to solve the above-mentioned problems. Accordingly, the method of operating the power system with the power apparatus for the X-ray tube includes following steps: (a) providing an X-ray tube, the X-ray tube having a cathode and an anode; (b) providing a power apparatus for the X-ray tube, the power apparatus configured to generate a positive voltage, a driving voltage, and a negative voltage; (c) providing a power switch unit; (d) outputting the negative voltage from the power apparatus to suppress electron flow energy generated from the cathode of the X-ray tube when the power switch unit is turned off by the driving voltage; and (e) outputting the positive voltage from the power apparatus to provide electron flow energy to the anode of the X-ray tube to produce X-ray when the power switch unit is turned on by the driving voltage.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWINGS

The features of the present disclosure believed to be novel are set forth with particularity in the appended claims. The present disclosure itself, however, may be best understood by reference to the following detailed description of the present disclosure, which describes an exemplary embodiment of the present disclosure, taken in conjunction with the accompanying drawings, in which:

DETAILED DESCRIPTION

Figure 1:
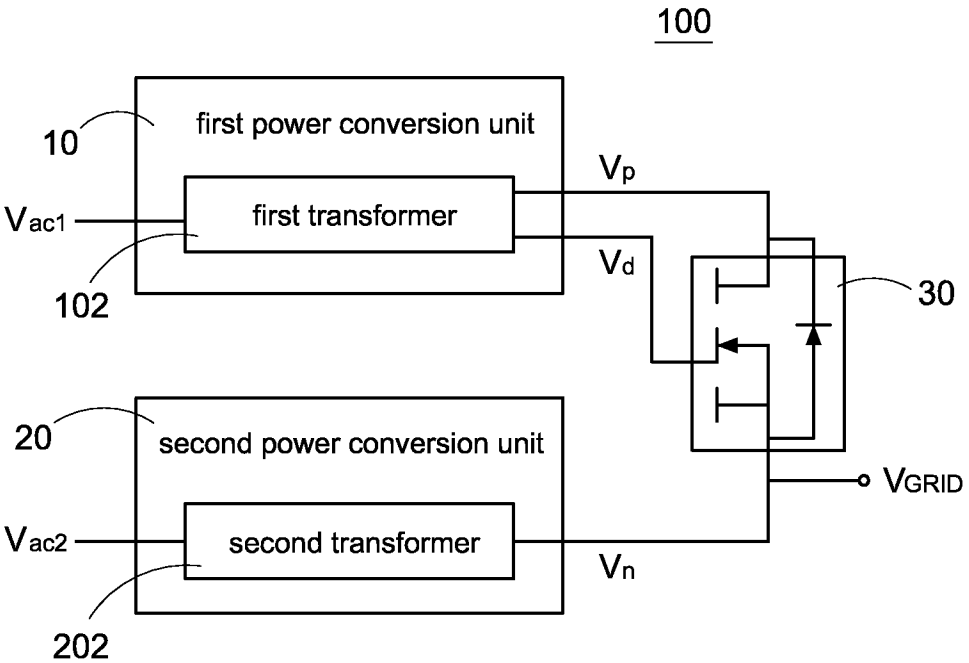
FIG. 1 is a block diagram of a power apparatus for an X-ray tube according to the present disclosure.

Reference will now be made to the drawing figures to describe the present invention in detail.

Reference is made to FIG. 1 which is a block diagram of a power apparatus for an X-ray tube according to the present disclosure. The power apparatus for the X-ray tube includes a first power conversion unit 10, a second power conversion unit 20, and a power switch unit 30. The power conversion unit 10 has a first transformer 102 and the first transformer 102 receives a first AC voltage Vac1 and converts the first AC voltage Vac1 to produce a positive voltage Vp and a driving voltage Vd. The second power conversion unit has a second transformer 202 and the second transformer 202 receives a second AC voltage Vac2 and converts the second AC voltage Vac2 to produce a negative voltage Vn. The power switch unit 30 is connected to the first transformer 102 and the second transformer 202. In particular, the first transformer 102 and the second transformer 202 are coupled to a negative high reference voltage $V_{-HVC}$. Also, the first transformer 102 is a grid transformer and the second transformer 202 is a filament transformer. The power switch unit 30 is a MOSFET (Metal-Oxide-Semiconductor Field-Effect Transistor), an IGBT (Insulated Gate Bipolar Transistor), a Transistor, or a SCR (Silicon-Controlled Rectifier). However, the embodiments are only exemplified but are not intended to limit the scope of the disclosure. When the power switch unit 30 is turned on by the driving voltage Vd, the power apparatus 100 outputs the positive voltage Vp, whereas the power apparatus 100 outputs the negative voltage Vn when the power switch unit 30 is turned off by the driving voltage Vd. The detailed circuit structure of the power apparatus 100 will be described hereinafter as follows.

Figure 2:
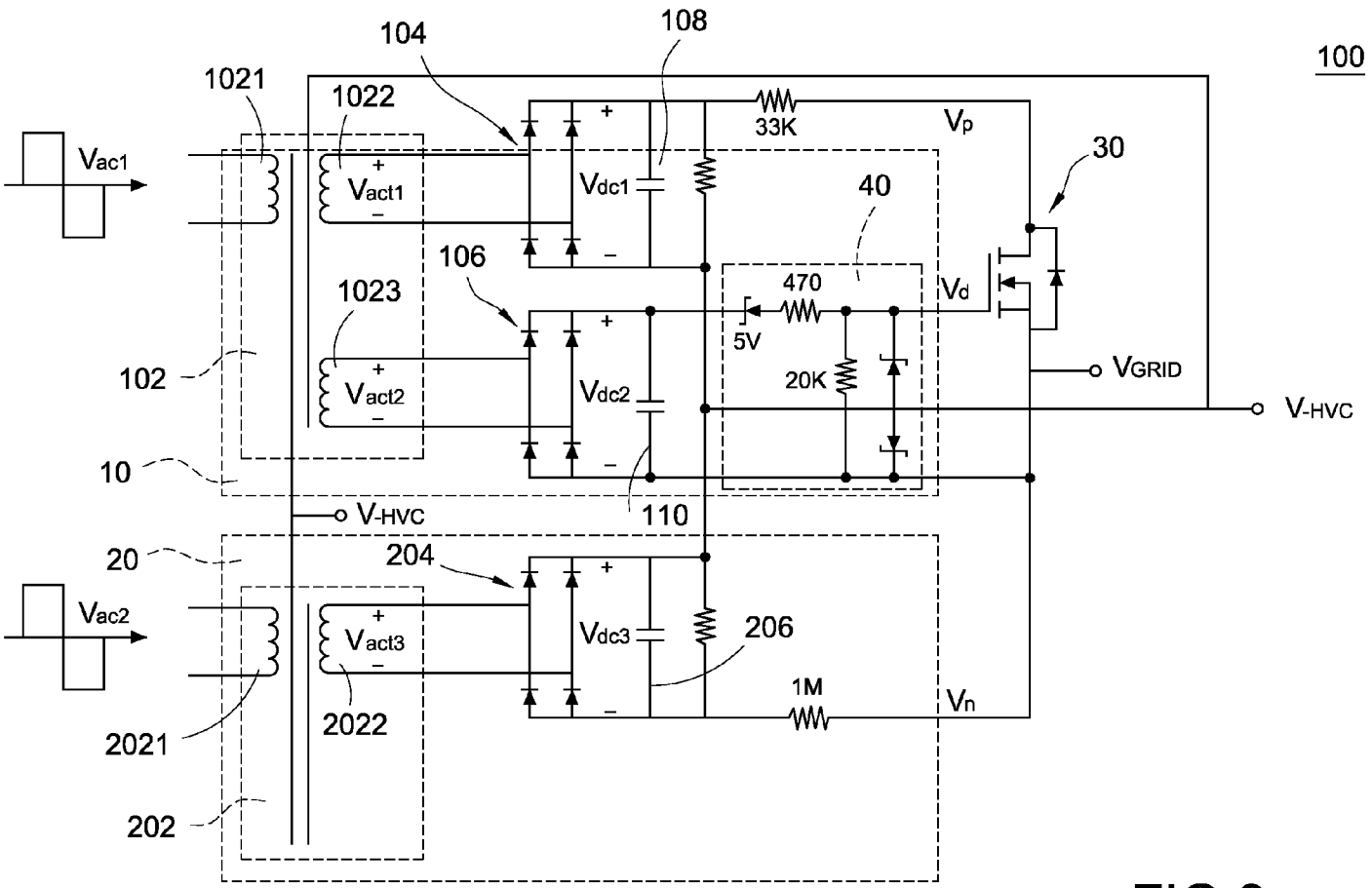
FIG. 2 is a circuit diagram of the power apparatus for the X-ray tube according to the present disclosure.

Reference is made to FIG. 2 which is a circuit diagram of the power apparatus for the X-ray tube according to the present disclosure. As mentioned above, the power apparatus 100 includes the first power conversion unit 10, the second power conversion unit 20, and the power switch unit 30. The first transformer 102 has a first primary-side winding 1021 and two secondary-side windings 1022,1023. The first primary-side winding 1021 receives the first AC voltage Vac1 and converts the first AC voltage Vac1 into a first AC converting voltage Vact1 and a second AC converting voltage Vact2 in the two secondary-side windings 1022,1023, respectively. The first power conversion unit 10 further includes a first rectifying circuit 104, a second rectifying circuit 106, a first filtering circuit 108, and a second filtering circuit 110. The first rectifying circuit 104 receives the first AC converting voltage Vact1 and rectifies the first AC converting voltage Vact1 into a first DC voltage Vdc1. The second rectifying circuit 106 receives the second AC converting voltage Vact2 and rectifies the second AC converting voltage Vact2 into a second DC voltage Vdc2. The first filtering circuit 108 receives the first DC voltage Vdc1 and filters the first DC voltage Vdc1 to produce the positive voltage Vp. The second filtering circuit 110 receives the second DC voltage Vdc2 and filters the second DC voltage Vdc2 to produce the driving voltage Vd. In addition, the power apparatus 100 further includes a regulating driving circuit 40 which is composed of resistors and Zener diodes. The regulating driving circuit 40 is connected to the second filtering circuit 110 to ensure that the power switch unit 30 is driven by the driving voltage Vd under the regulation operation.

The second transformer 202 has a first primary-side winding 2021 and two secondary-side windings 2022,2023. The first primary-side winding 2021 receives the second AC voltage Vac2 and converts the second AC voltage Vac2 into a third AC converting voltage Vact3 in one of the secondary-side windings 2022. The second power conversion unit 20 further includes a third rectifying circuit 204 and a third filtering circuit 206. The third rectifying circuit 204 receives the third AC converting voltage Vact3 and rectifies the third AC converting voltage Vact3 into a third DC voltage Vdc3. The third filtering circuit 206 receives the third DC voltage Vdc3 and filters the third DC voltage Vdc3 to produce the negative voltage Vn.

Figure 3:
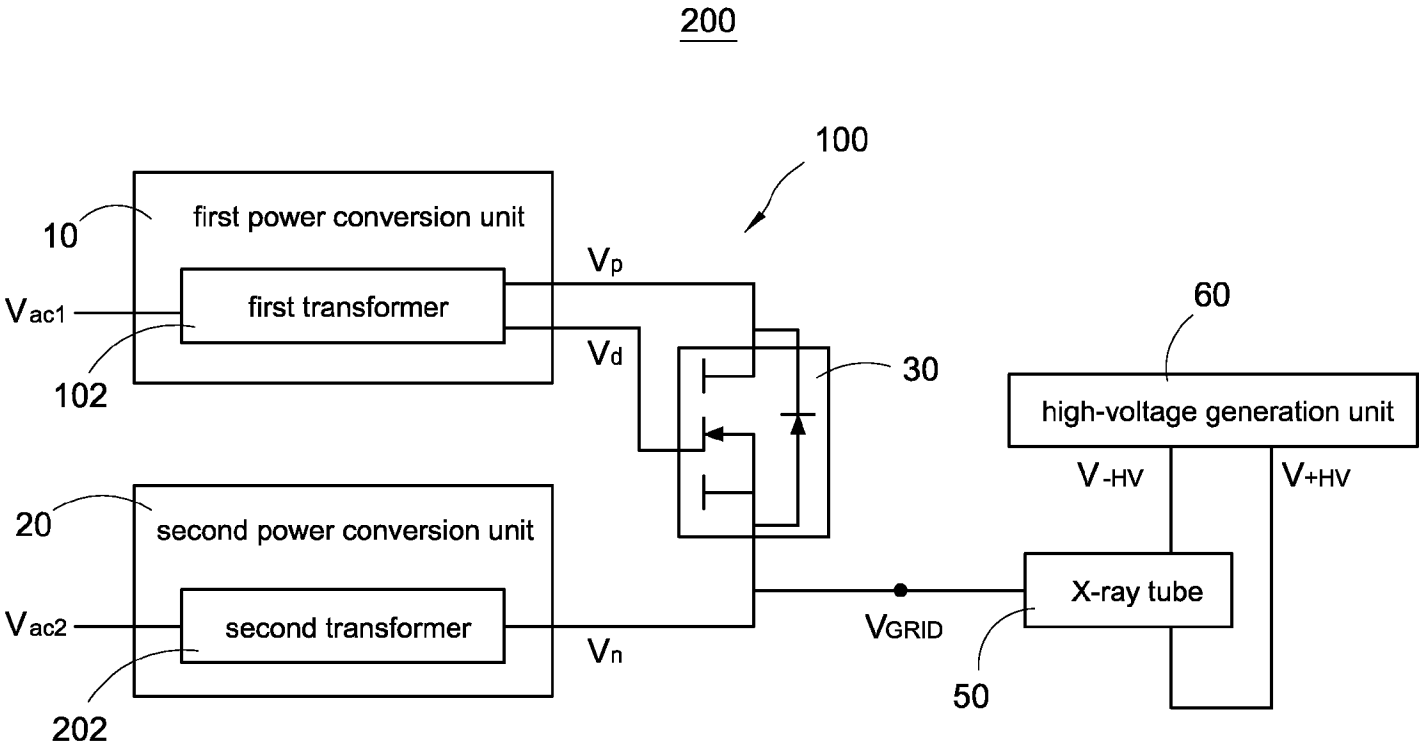
FIG. 3 is a block diagram of a power system with the power apparatus for the X-ray tube according to the present disclosure.

Reference is made to FIG. 3 which is a block diagram of a power system with the power apparatus for the X-ray tube according to the present disclosure. The power system 200 includes an X-ray tube 50 and a power apparatus 100 for the X-ray tube. The X-ray tube 50 has a cathode Tc and an anode Ta. The cathode Tc is usually a filament for producing electrons and the anode Ta is a tungsten target for providing an area on which that electrons strike. In addition, the space between the cathode Tc and the anode Ta maintains a vacuum in the tube. The power apparatus 100 is electrically connected to the X-ray tube 50. The power apparatus 100 includes a first power conversion unit 10, a second power conversion unit 20, and a power switch unit 30. The first power conversion unit 10 has a first transformer 102 and the first transformer 102 receives a first AC voltage Vac1 and converts the first AC voltage Vac1 to produce a positive voltage Vp and a driving voltage Vd. The second power conversion unit 20 has a second transformer 202 and the second transformer 202 receives a second AC voltage Vac2 and converts the second AC voltage Vac2 to produce a negative voltage Vn. The power switch unit 30 is connected to the first transformer 102 and the second transformer 202. In particular, the first transformer 102 and the second transformer 202 are coupled to a negative high reference voltage $V_{-HVC}$. Also, the first transformer 102 is a grid transformer and the second transformer 202 is a filament transformer. The power switch unit 30 is a MOSFET (Metal-Oxide-Semiconductor Field-Effect Transistor), an IGBT (Insulated Gate Bipolar Transistor), a Transistor, or a SCR (Silicon-Controlled Rectifier). However, the embodiments are only exemplified but are not intended to limit the scope of the disclosure. The power system 200 further includes a high-voltage generation unit 60. The high-voltage generation unit 60 generates a negative high voltage $V_{-HV}$ and a positive high voltage $V_{+HV}$ to supply power to the cathode Tc and the anode Ta of the X-ray tube 50, respectively, so as to accelerate the electron beam in the tube. When the power switch unit 30 is turned off by the driving voltage Vd, the power apparatus 100 outputs the negative voltage Vn to suppress electron flow energy generated from the cathode Tc of the X-ray tube 50, whereas the power apparatus 100 outputs the positive voltage Vp to provide electron flow energy to the anode Ta of the X-ray tube 50 to produce X-ray when the power switch unit 30 is turned on by the driving voltage Vd. The detailed circuit structure of the power apparatus 100 will be described hereinafter as follows. The detailed circuit structure of the power apparatus 100 will be described hereinafter as follows.

Figure 4:
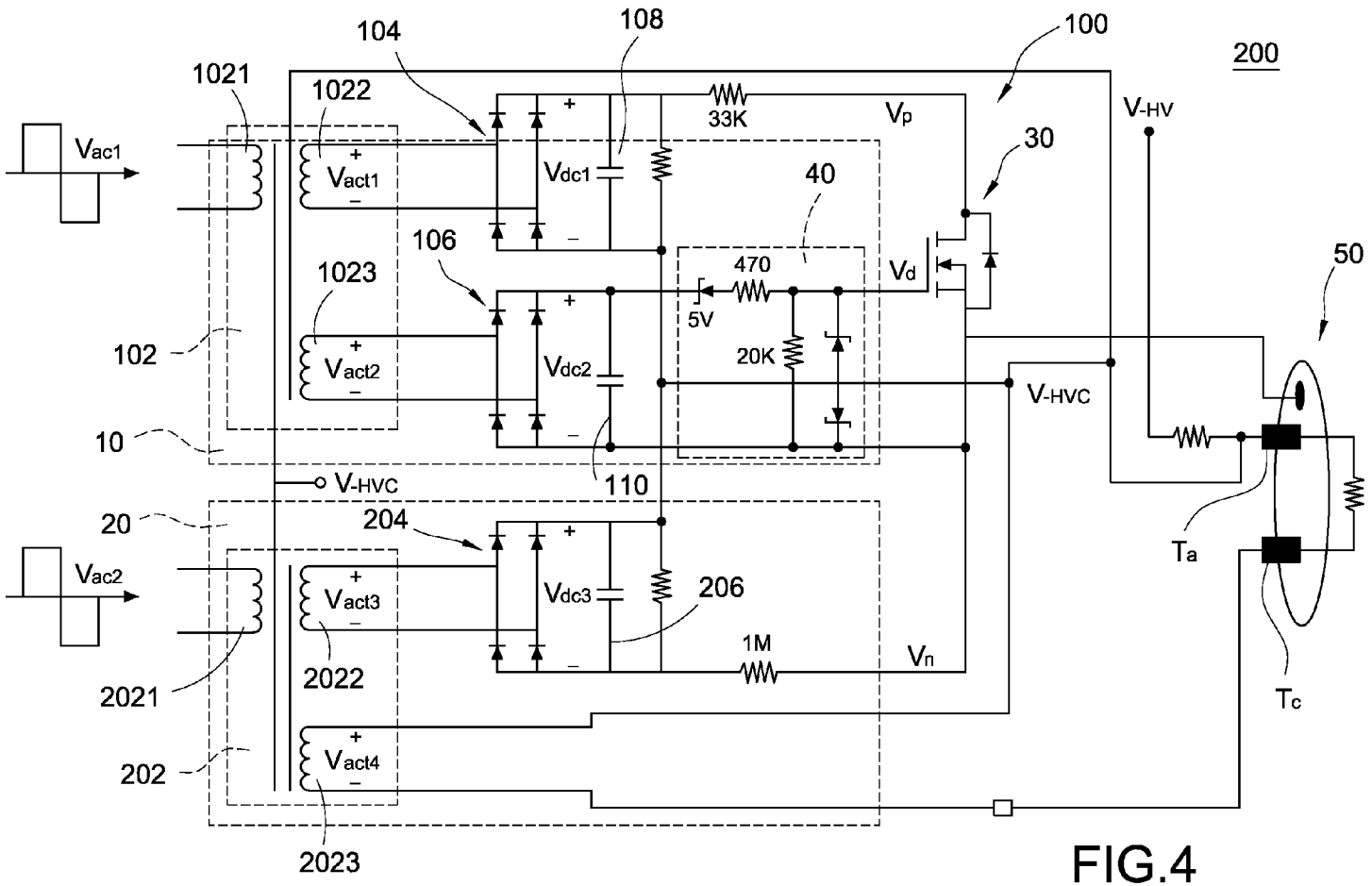
FIG. 4 is a circuit block diagram of the power system with the power apparatus for the X-ray tube according to the present disclosure.

Reference is made to FIG. 4 which is a circuit block diagram of the power system with the power apparatus for the X-ray tube according to the present disclosure. As mentioned above, the power apparatus 100 includes the first power conversion unit 10, the second power conversion unit 20, and the power switch unit 30. The first transformer 102 has a first primary-side winding 1021 and two secondary-side windings 1022,1023. The first primary-side winding 1021 receives the first AC voltage Vac1 and converts the first AC voltage Vac1 into a first AC converting voltage Vact1 and a second AC converting voltage Vact2 in the two secondary-side windings 1022,1023, respectively. The first power conversion unit 10 further includes a first rectifying circuit 104, a second rectifying circuit 106, a first filtering circuit 108, and a second filtering circuit 110. The first rectifying circuit 104 receives the first AC converting voltage Vact1 and rectifies the first AC converting voltage Vact1 into a first DC voltage Vdc1. The second rectifying circuit 106 receives the second AC converting voltage Vact2 and rectifies the second AC converting voltage Vact2 into a second DC voltage Vdc2. The first filtering circuit 108 receives the first DC voltage Vdc1 and filters the first DC voltage Vdc1 to produce the positive voltage Vp. The second filtering circuit 110 receives the second DC voltage Vdc2 and filters the second DC voltage Vdc2 to produce the driving voltage Vd. In addition, the power apparatus 100 further includes a regulating driving circuit 40 which is composed of resistors and Zener diodes. The regulating driving circuit 40 is connected to the second filtering circuit 110 to ensure that the power switch unit 30 is driven by the driving voltage Vd under the regulation operation.

The second transformer 202 has a first primary-side winding 2021 and two secondary-side windings 2022,2023. The first primary-side winding 2021 receives the second AC voltage Vac2 and converts the second AC voltage Vac2 into a third AC converting voltage Vact3 in one of the secondary-side windings 2022. The second power conversion unit 20 further includes a third rectifying circuit 204 and a third filtering circuit 206. The third rectifying circuit 204 receives the third AC converting voltage Vact3 and rectifies the third AC converting voltage Vact3 into a third DC voltage Vdc3. The third filtering circuit 206 receives the third DC voltage Vdc3 and filters the third DC voltage Vdc3 to produce the negative voltage Vn. Especially, the other secondary-side winding 2023 of the second transformer 202 produces a fourth AC converting voltage Vact4 to provide the required voltage for preheating the cathode Tc of the X-ray tube 50.

Therefore, the power switch unit 30 is driven from the turned-off condition to the turned-on condition when users operate to drive the X-ray tube 50. Hence, the output voltage of the power apparatus 100 is switched from the negative voltage Vn to the positive voltage Vp so as to provide electron flow energy to the anode Ta of the X-ray tube 50 to produce X-ray. Especially, in this embodiment, the negative voltage Vn typically ranges from 0 to −200 volts, and the positive voltage Vp typically ranges from 300 to 500 volts.

Figure 5:
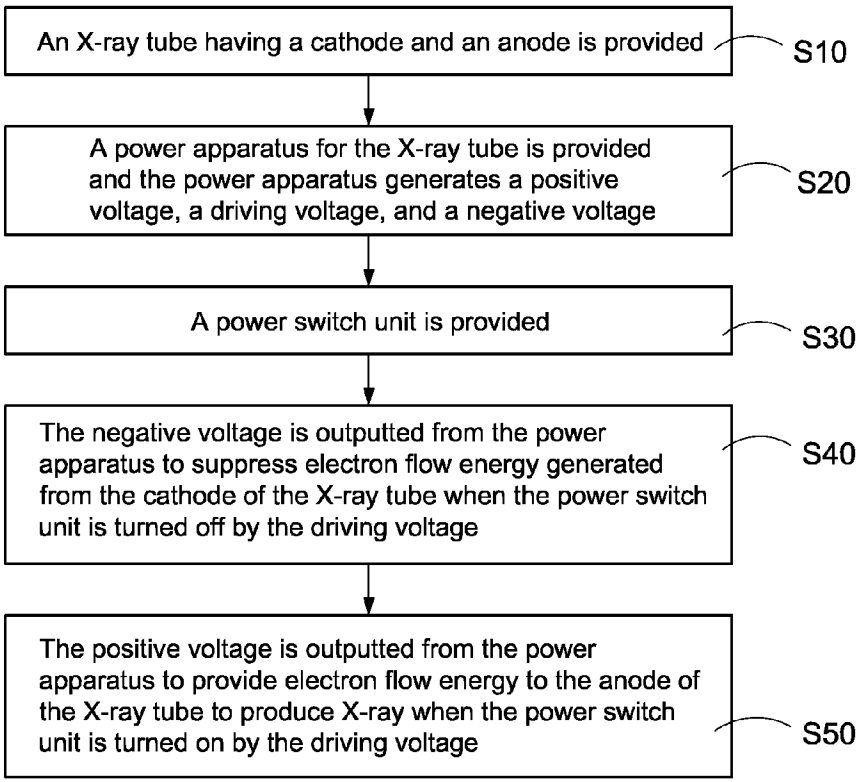
FIG. 5 is a flowchart of a method of operating the power system with the power apparatus for the X-ray tube according to the present disclosure.

Reference is made to FIG. 5 which is a flowchart of a method of operating the power system with the power apparatus for the X-ray tube according to the present disclosure. The method includes following steps: An X-ray tube is provided (S10). The X-ray tube has a cathode and an anode. Afterward, a power apparatus for the X-ray tube is provided. The power apparatus generates a positive voltage, a driving voltage, and a negative voltage (S20). In particular, the power apparatus is electrically connected to the X-ray tube. The power apparatus includes a first power conversion unit, a second power conversion unit, and a power switch unit. The first power conversion unit has a first transformer and the first transformer receives a first AC voltage and converts the first AC voltage to produce the positive voltage and the driving voltage. The second power conversion unit has a second transformer and the second transformer receives a second AC voltage and converts the second AC voltage to produce the negative voltage.

The first transformer has a first primary-side winding and two secondary-side windings. The first primary-side winding receives the first AC voltage and converts the first AC voltage into a first AC converting voltage and a second AC converting voltage in the two secondary-side windings, respectively. The first power conversion unit further includes a first rectifying circuit, a second rectifying circuit, a first filtering circuit, and a second filtering circuit. The first rectifying circuit receives the first AC converting voltage and rectifies the first AC converting voltage into a first DC voltage. The second rectifying circuit receives the second AC converting voltage and rectifies the second AC converting voltage into a second DC voltage. The first filtering circuit receives the first DC voltage and filters the first DC voltage to produce the positive voltage. The second filtering circuit receives the second DC voltage and filters the second DC voltage to produce the driving voltage. In addition, the power apparatus of the X-ray tube further includes a regulating driving circuit which is composed of resistors and Zener diodes. The regulating driving circuit is connected to the second filtering circuit to ensure that the power switch unit is driven by the driving voltage under the regulation operation.

The second transformer has a first primary-side winding and two secondary-side windings. The first primary-side winding receives the second AC voltage and converts the second AC voltage into a third AC converting voltage in one of the secondary-side windings. The second power conversion unit further includes a third rectifying circuit and a third filtering circuit. The third rectifying circuit receives the third AC converting voltage and rectifies the third AC converting voltage into a third DC voltage. The third filtering circuit receives the third DC voltage and filters the third DC voltage to produce the negative voltage. Especially, the other secondary-side winding of the second transformer produces a fourth AC converting voltage to provide the required voltage for preheating the cathode of the X-ray tube.

Afterward, a power switch unit is provided (S30). The power switch unit is connected to the first transformer and the second transformer and first transformer and the second transformer are coupled to a negative high reference voltage. Also, the first transformer is a grid transformer and the second transformer is a filament transformer. The power switch unit is a MOSFET (Metal-Oxide-Semiconductor Field-Effect Transistor), an IGBT (Insulated Gate Bipolar Transistor), a Transistor, or a SCR (Silicon-Controlled Rectifier). However, the embodiments are only exemplified but are not intended to limit the scope of the disclosure. Afterward, the negative voltage is outputted from the power apparatus to suppress electron flow energy generated from the cathode of the X-ray tube when the power switch unit is turned off by the driving voltage (S40). The positive voltage is outputted from the power apparatus to provide electron flow energy to the anode of the X-ray tube to produce X-ray when the power switch unit is turned on by the driving voltage (S50).

In conclusion, the present disclosure has following advantages:

1. The power switch unit 30 is used with the corresponding driving circuit to implement the polarity control of the grid voltage $V_{GRID}$, that is, the power switch unit 30 is driven from the turned-off condition to the turned-on condition when users operate to drive the X-ray tube 50. Accordingly, the output voltage of the power apparatus 100 is switched from the negative voltage Vn to the positive voltage Vp so as to provide electron flow energy to the anode Ta of the X-ray tube 50 to produce X-ray; and 2. Only one power switch unit 30 is used to implement the polarity control of the grid voltage $V_{GRID}$ so as to reduce system costs and increase system operation stability.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. A power apparatus for an X-ray tube comprising:

a first power conversion unit having a first transformer, the first transformer configured to receive a first AC voltage and convert the first AC voltage to produce a positive voltage and a driving voltage;

a second power conversion unit having a second transformer, the second transformer configured to receive a second AC voltage and convert the second AC voltage to produce a negative voltage; and a power switch unit connected to the first transformer and the second transformer;

wherein the power apparatus is configured to output the positive voltage when the power switch unit is turned on by the driving voltage; the power apparatus is configured to output the negative voltage when the power switch unit is turned off by the driving voltage.

2. The power apparatus for the X-ray tube in claim 1, wherein the first transformer has a first primary-side winding and two secondary-side windings, the first primary-side winding is configured to receive the first AC voltage and convert the first AC voltage into a first AC converting voltage and a second AC converting voltage in the two secondary-side windings, respectively; the first power conversion unit further comprises:

a first rectifying circuit configured to receive the first AC converting voltage and rectify the first AC converting voltage into a first DC voltage;

a second rectifying circuit configured to receive the second AC converting voltage and rectify the second AC converting voltage into a second DC voltage;

a first filtering circuit configured to receive the first DC voltage and filter the first DC voltage to produce the positive voltage; and a second filtering circuit configured to receive the second DC voltage and filter the second DC voltage to produce the driving voltage.

3. The power apparatus for the X-ray tube in claim 2, wherein the second transformer has a first primary-side winding and two secondary-side windings, the first primary-side winding is configured to receive the second AC voltage and convert the second AC voltage into a third AC converting voltage in one of the secondary-side windings; the second power conversion unit further comprises:

a third rectifying circuit configured to receive the third AC converting voltage and rectify the third AC converting voltage into a third DC voltage; and a third filtering circuit configured to receive the third DC voltage and filter the third DC voltage to produce the negative voltage.

4. The power apparatus for the X-ray tube in claim 2, further comprising:

a regulating driving circuit connected to the second filtering circuit and configured to provide the driving voltage to the power switch unit under a regulation operation.

5. The power apparatus for the X-ray tube in claim 1, wherein the first transformer and the second transformer are coupled to a negative high reference voltage; the first transformer is a grid transformer and the second transformer is a filament transformer.

6. The power apparatus for the X-ray tube in claim 1, wherein the power switch unit is a MOSFET, an IGBT, a Transistor, or a SCR.

7. A power system with a power apparatus for an X-ray tube comprising:

an X-ray tube having a cathode and an anode; and a power apparatus for the X-ray tube electrically connected to the X-ray tube, the power apparatus comprising:

a first power conversion unit having a first transformer, the first transformer configured to receive a first AC voltage and convert the first AC voltage to produce a positive voltage and a driving voltage;

a second power conversion unit having a second transformer, the second transformer configured to receive a second AC voltage and convert the second AC voltage to produce a negative voltage; and a power switch unit connected to the first transformer and the second transformer;

wherein the power apparatus is configured to output the positive voltage when the power switch unit is turned on by the driving voltage; the power apparatus is configured to output the negative voltage when the power switch unit is turned off by the driving voltage.

8. The power system with the power apparatus in claim 7, wherein the first transformer has a first primary-side winding and two secondary-side windings, the first primary-side winding is configured to receive the first AC voltage and convert the first AC voltage into a first AC converting voltage and a second AC converting voltage in the two secondary-side windings, respectively; the first power conversion unit further comprises:

a first rectifying circuit configured to receive the first AC converting voltage and rectify the first AC converting voltage into a first DC voltage;

a second rectifying circuit configured to receive the second AC converting voltage and rectify the second AC converting voltage into a second DC voltage;

a first filtering circuit configured to receive the first DC voltage and filter the first DC voltage to produce the positive voltage; and a second filtering circuit configured to receive the second DC voltage and filter the second DC voltage to produce the driving voltage.

9. The power system with the power apparatus in claim 8, wherein the second transformer has a first primary-side winding and two secondary-side windings, the first primary-side winding is configured to receive the second AC voltage and convert the second AC voltage into a third AC converting voltage in one of the secondary-side windings; the second power conversion unit further comprises:

a third rectifying circuit configured to receive the third AC converting voltage and rectify the third AC converting voltage into a third DC voltage; and a third filtering circuit configured to receive the third DC voltage and filter the third DC voltage to produce the negative voltage.

10. The power system with the power apparatus in claim 9, wherein the other secondary-side winding of the second transformer is configured to produce a fourth AC converting voltage to provide the required voltage for preheating the cathode of the X-ray tube.

11. The power system with the power apparatus in claim 8, wherein the power apparatus for the X-ray tube further comprises:

a regulating driving circuit connected to the second filtering circuit and configured to provide the driving voltage to the power switch unit under a regulation operation.

12. The power system with the power apparatus in claim 7, wherein the first transformer and the second transformer are coupled to a negative high reference voltage; the first transformer is a grid transformer and the second transformer is a filament transformer.

13. The power system with the power apparatus in claim 7, further comprising:

a high-voltage generation unit configured to generate a negative high voltage and a positive high voltage to supply power to the cathode and the anode of the X-ray tube, respectively.

14. A method of operating a power system with a power apparatus for an X-ray tube comprising the following steps:

(a) providing an X-ray tube, the X-ray tube having a cathode and an anode;

(b) providing a power apparatus for the X-ray tube, the power apparatus configured to generate a positive voltage, a driving voltage, and a negative voltage;

(c) providing a power switch unit;

(d) outputting the negative voltage from the power apparatus to suppress electron flow energy generated from the cathode of the X-ray tube when the power switch unit is turned off by the driving voltage; and (e) outputting the positive voltage from the power apparatus to provide electron flow energy to the anode of the X-ray tube to produce X-ray when the power switch unit is turned on by the driving voltage.

15. The method of operating the power system with the power apparatus in claim 14, wherein the power apparatus for the X-ray tube is electrically connected to the X-ray tube; the power apparatus comprises:

a first power conversion unit having a first transformer, the first transformer configured to receive a first AC voltage and convert the first AC voltage to produce a positive voltage and a driving voltage; and a second power conversion unit having a second transformer, the second transformer configured to receive a second AC voltage and convert the second AC voltage to produce a negative voltage.

16. The method of operating the power system with the power apparatus in claim 15, wherein the first transformer has a first primary-side winding and two secondary-side windings, the first primary-side winding is configured to receive the first AC voltage and convert the first AC voltage into a first AC converting voltage and a second AC converting voltage in the two secondary-side windings, respectively; the first power conversion unit further comprises:

a first rectifying circuit configured to receive the first AC converting voltage and rectify the first AC converting voltage into a first DC voltage;

a second rectifying circuit configured to receive the second AC converting voltage and rectify the second AC converting voltage into a second DC voltage;

a first filtering circuit configured to receive the first DC voltage and filter the first DC voltage to produce the positive voltage; and a second filtering circuit configured to receive the second DC voltage and filter the second DC voltage to produce the driving voltage.

17. The method of operating the power system with the power apparatus in claim 16, wherein the second transformer has a first primary-side winding and two secondary-side windings, the first primary-side winding is configured to receive the second AC voltage and convert the second AC voltage into a third AC converting voltage in one of the secondary-side windings; the second power conversion unit further comprises:

a third rectifying circuit configured to receive the third AC converting voltage and rectify the third AC converting voltage into a third DC voltage; and a third filtering circuit configured to receive the third DC voltage and filter the third DC voltage to produce the negative voltage.

18. The method of operating the power system with the power apparatus in claim 17, wherein the other secondary-side winding of the second transformer is configured to produce a fourth AC converting voltage to provide the required voltage for preheating the cathode of the X-ray tube.

19. The method of operating the power system with the power apparatus in claim 16, wherein the power apparatus for the X-ray tube further comprises:

a regulating driving circuit connected to the second filtering circuit and configured to provide the driving voltage to the power switch unit under a regulation operation.

20. The method of operating the power system with the power apparatus in claim 15, further comprising:

a high-voltage generation unit configured to generate a negative high voltage and a positive high voltage to supply power to the cathode and the anode of the X-ray tube, respectively.

* * * * *